US006153837A

United States Patent [19]

Garcia et al.

[11] Patent Number: 6,153,837

[45] Date of Patent: Nov. 28, 2000

[54] CONTROL UNIT FOR AN ELECTRICAL HOUSEHOLD APPLIANCE

[75] Inventors: Jose Andres Garcia, Zaragoza, Spain; Joachim Reichard, Starnberg, Germany; Felicitas Ziegler, Stein, Germany; Manfred Plankl, Traunreut, Germany; Hans Lappat, Garching/Alz, Germany; Armin Sigmund, Traunreut, Germany; Bernd Stitzl, Lauter, Germany; Michael Wagner, Grabenstätt, Germany; Kurt Knebel, Traunreut, Germany; Klaus Erdmann, Bretten, Germany; Hans Linde, Coburg, Germany; Uwe Neumann, Bamberg, Germany; Andreas Rehklau, Freising, Germany

[73] Assignee: BSH Bosch und Siemens Haushaltsgeraete GmbH, Munich, Germany

[21] Appl. No.: 09/327,012

[22] Filed: Jun. 7, 1999

[30] Foreign Application Priority Data

Jun. 5, 1998 [DE] Germany ..... 198 25 310

[51] Int. Cl.[7] ..... H01H 3/00

[52] U.S. Cl. ..... 200/18; 200/6 A

[58] Field of Search ..... 200/18, 23, 24, 200/6 R, 5 R, 6 A, 308–317

[56] References Cited

U.S. PATENT DOCUMENTS

| | | | |
|---|---|---|---|
| 3,585,319 | 6/1971 | Payerle | 200/6 A |
| 3,786,219 | 1/1974 | Kornrumpf et al. | 5/4 |
| 4,479,038 | 10/1984 | Marhold et al. | 200/6 A |
| 5,261,387 | 11/1993 | Gressenich | 126/39 H |
| 5,796,346 | 8/1998 | Wash et al. | 340/635 |

*Primary Examiner*—Michael L. Gellner
*Assistant Examiner*—Nhung Nguyen
*Attorney, Agent, or Firm*—Herbert L. Lerner; Laurence A. Greenberg; Werner H. Stemer

[57] ABSTRACT

A control unit for setting operating functions and operating parameters in an electrical household appliance includes a control knob retained on a control area. The control knob can be rotated about a knob axis for setting the operating parameters of, for example, a heating level. In order to simplify operation of the control unit, the control knob can be tilted or pushed out of an initial position or knob axis, into a selection position in order to select a specific operating function, for example a specific cooking position.

14 Claims, 2 Drawing Sheets

CONTROL UNIT FOR AN ELECTRICAL HOUSEHOLD APPLIANCE

BACKGROUND OF THE INVENTION

Field of the Invention

The present invention relates to a control unit for setting operating functions and operating parameters for an electrical household appliance, including a control knob retained on a control area, wherein the control knob can be rotated about a knob axis in order to set an operating parameter of, for example, a heating level.

Such a control unit is known from European Patent EP 0 448 005 B1, in which a control device is specified in the form of a control panel including indicator elements, having a control element for the selection of functions and/or operator programs, with a pulse generating device for the input of function values allocated to functions, e.g. such values as times, temperatures or speeds, and with a control element for starting a selected program. In that instance a first control element is formed as a ring-shaped rotary selector switch and a second control element is formed from a pulse generating device in the form of a rotary knob which can be rotated in a circumferential direction. The rotary selector switch and the rotary knob are combined into a multifunctional switch, whereby the rotary switch is disposed concentrically around the rotary knob. On one hand, that multifunctional switch is easy to use and readily understandable and, on the other hand, has the advantage that it is assembled from only a few individual parts. It also saves space so that the control panel can be made smaller.

SUMMARY OF THE INVENTION

It is accordingly an object of the invention to provide a control unit for an electrical household appliance, which overcomes the hereinafore-mentioned disadvantages of the heretofore-known devices of this general type and which has a simplified operation.

With the foregoing and other objects in view there is provided, in accordance with the invention, a control unit for setting operating functions and operating parameters of an electrical household appliance, comprising a control area; and a control knob retained at the control area; the control knob to be rotated about a knob axis to set operating parameters, for example a heating level; and the control knob to be tilted or pushed from an initial position or out of the knob axis into a selection position for selecting a specific operating function, for example a specific cooking position of a cook top.

Operator convenience is increased in a simple way through the simultaneous use of the rotating movement and the tilting or pushing movement of the control knob. The control knob can remain constantly in the hand of an operator from the first operative step (selection of the operating function) to the second operative step (setting the operating parameters of the selected operating function). It is necessary neither to change the grip nor to operate any additional element of the control unit. In addition, each operative step is assigned its own characteristic manner of moving the operating knob.

In accordance with another feature of the invention, the control knob has a return mechanism which automatically moves the control knob back into the initial position after its movement into the extended position. This increases the operating convenience even further because the control knob always moves back into the initial position.

In accordance with a further feature of the invention, a closed control area can be provided, in particular, if the control knob and the control area are fitted with magnetic elements through which the operating knob is retained on the control area while still being capable of being moved. It is possible to dispense entirely with openings through the control area, which are especially critical in the case of soiling.

In accordance with an added feature of the invention, cleaning is also simplified since the control knob can be removed from the control area during normal operation.

In accordance with an additional feature of the invention, the control knob and the control area have mutually corresponding mechanical guiding elements. This guarantees that the control knob can be led with certainty into each of the intended different selection positions.

In accordance with yet another feature of the invention, with respect to the soiling of the control unit and its visual appearance, it is advantageous for the control knob to completely cover the guiding elements in every position of the control knob.

In accordance with yet a further feature of the invention, in order to reduce the tendency to soiling, the control knob has a knob foot which is fastened on a raised, essentially ball-shaped, knob foot bearing in such a way that the knob foot can be rotated and turned. In order to increase operating convenience an appropriately shaped knob foot area slides on the spherical-segment shaped surface of the knob foot bearing.

In accordance with yet an added feature of the invention, operation of the control knob is particularly clear and easy to understand if it is provided with a display unit which has a display element in each of the tilt or push directions of the control knob. A physical approach of the control knob to the respective display element results in a corresponding selection of the operating function or setting of the operating parameter. In this regard, the spatial configuration of the display elements can, for example, be modeled on the spatial configuration of the cooking positions of a cook top.

In accordance with yet an additional feature of the invention, in order to provide a further increase in operator convergence the initial position of the rotary knob is located approximately at the center of gravity of an area bounded by at least three selection positions of the control knob.

In accordance with again another feature of the invention, in order to simplify operation, the household appliance can be switched off by turning the control knob in the initial position. If necessary because of safety, the household appliance can be fitted with an additional on/off switch independent of the control knob.

In accordance with again a further feature of the invention, the control knob is rotatable in the selection position.

In accordance with again an added feature of the invention, there is provided a rotation detector, a shaft connected between the rotation detector and the control knob, and the control knob or the shaft having a position detector.

In accordance with a concomitant feature of the invention, the household appliance having the control unit is a household cook top or oven.

Other features which are considered as characteristic for the invention are set forth in the appended claims.

Although the invention is illustrated and described herein as embodied in a control unit for an electrical household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
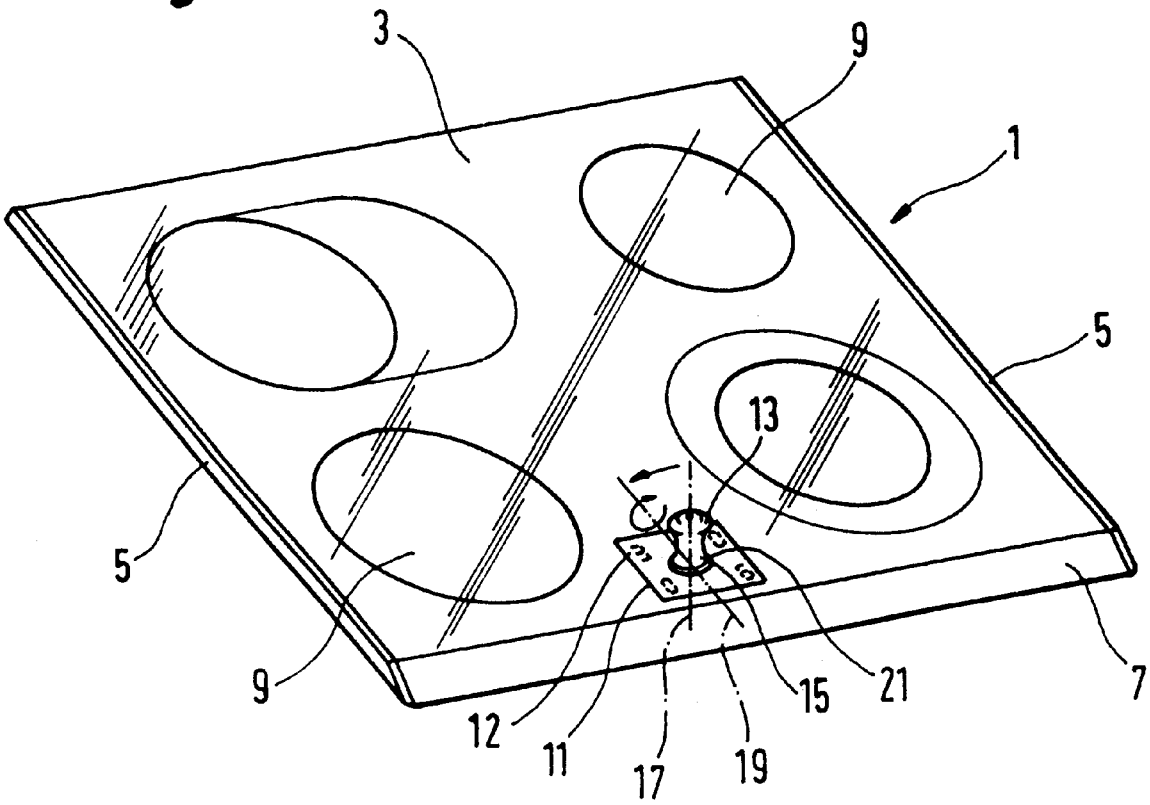
FIG. 1 is a diagrammatic, perspective view of a cook top with a control unit.

Referring now to the figures of the drawings in detail and first, particularly, to FIG. 1 thereof, there is seen a cook top 1 that has a glass-ceramic panel 3, on both sides of which framing strips 5 are fastened. A front end of the glass-ceramic panel has a bevel 7. The glass-ceramic panel 3 is provided with four heatable cooking positions 9, which are known per se and are marked with a pattern. A prefabricated display unit 11, which has been tested outside the cook top 1, is set flush and sealed on all sides into an opening in the glass-ceramic panel 3 adjacent the bevel 7. The rectangularly shaped display unit 11 has a display element 12 in each corner in the form of a known seven-segment display. In addition, the display unit 11 can also have further non-illustrated display elements to show, for example, the desired operating mode for an oven located beneath the cook top 1, e.g. top/bottom heat and the temperature of the oven.

A control knob 13 is fixed at the center of the display unit 11. The control knob 13 has a knob foot 15 formed at its lower end section. In an initial position of the control knob 13, a knob axis 17 stands perpendicularly to the surface of the display unit 11 and the glass-ceramic panel 3. In order to select or call-up a specific cooking position 9, the control knob 13 is moved approximately along the diagonal of the rectangular display unit 11 towards the corresponding display element 12. The spatial configuration of the display elements 12 within the display unit 11 thereby corresponds to the spatial configuration of the cooking positions 9 on the glass-ceramic panel 3 shown in FIG. 1.

Figure 2:
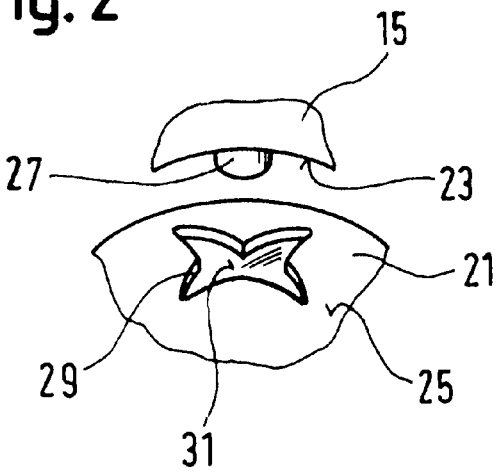
FIG. 2 is a partially enlarged, fragmentary, perspective view of the control unit with a control knob raised from a control area in accordance with a first embodiment example.

In order to tilt the axis 17 of the control knob 13 out of the initial position into one of four illustrated selection positions indicated by reference numeral 19 in accordance with the first embodiment example, the knob foot 15 sits on a ball-like knob foot bearing 21 which is constructed in the shape of a spherical segment as is shown in FIG. 2. The knob foot bearing 21 is set in an opening in the display unit 11 and sealed on all sides. The underside of the knob foot 15 is dome-shaped corresponding to the spherical segment shaped formation of the knob foot 21. A foot sliding surface 23 is thereby provided which slides on a correspondingly shaped bearing sliding surface or control area 25 when the control knob 13 is tilted out of the initial position along the axis 17.

In accordance with European Patent Application EP 0 797 227 A2, the control knob 13 is retained on the knob foot bearing 21 solely through magnetic force and can therefore be removed during normal operation. Suitable magnetic elements are provided in the area of the lower end section of the knob foot 15 and corresponding elements in the knob foot bearing 21 in accordance with what is disclosed in European Patent Application EP 0 797 227 A2. The knob foot 15 has a guide element or pin 27 projecting from the foot sliding surface 23 in order to improve the guiding of the control knob 13, especially into the four selection positions indicated by reference numeral 19. The guide pin 27 can also be realized as a magnetic element if required. The guide pin 27 is guided in a guiding element or star 29 which is constructed as a recess in an upper surface of the knob foot bearing. A closed star floor 31 of the guiding star 29 is provided approximately 0.5 mm below the bearing sliding surface 25 of the knob foot bearing 21 shown in FIG. 2.

Figure 3:
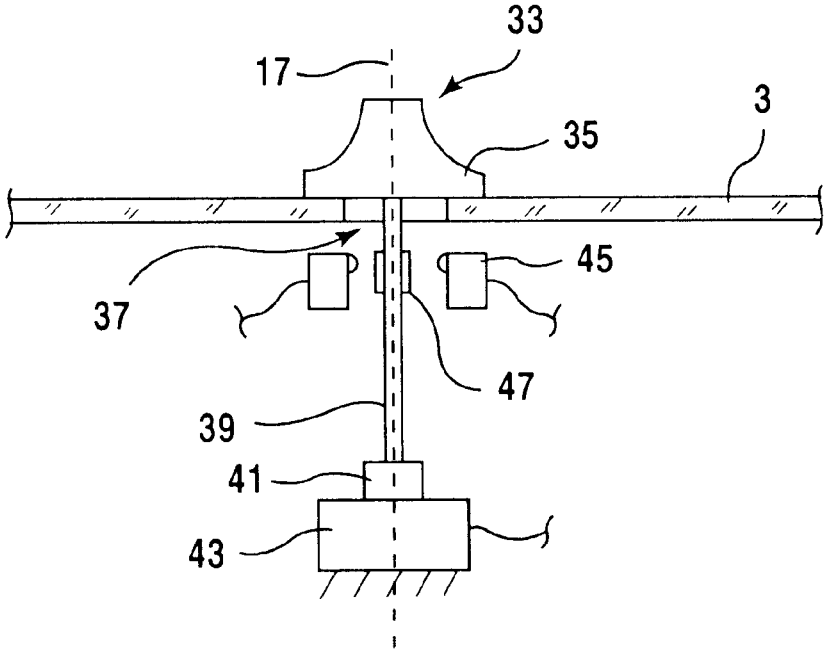
FIG. 3 is a fragmentary, sectional view of the cook top with the control unit in accordance with a second embodiment example.

In accordance with the second embodiment example shown in FIG. 3, a knob 33 is retained on the top of the glass-ceramic panel 3 and has a knob foot 35. The knob foot 35 is constructed in such a way that in all possible positions of the knob 33 it covers an opening 37 in the glass-ceramic panel 3. The opening 37 is located beneath the knob foot 35. If necessary, suitable sealing elements can be provided between the bottom of the knob foot 35 and the top of the glass-ceramic panel 3. A flexible shaft 39, which is fixed to the knob 33 so as to rotate with the knob, projects downwards through the opening 37. At an opposite end section, the flexible shaft 39 is fixed to a shaft receiver 41 of a rotation detector 43 fixed in a housing. The shaft 39 and the receiver 41 are fastened so as to rotate together. Four microswitches 45 are also fixed beneath the glass-ceramic panel 3. The microswitches are disposed peripherally and equidistant from the shaft 39 and in such a way that they can be operated through switch operating surfaces 47 of the shaft 39 upon a suitable movement of the knob 33 and therewith the shaft 39.

Figure 4A:
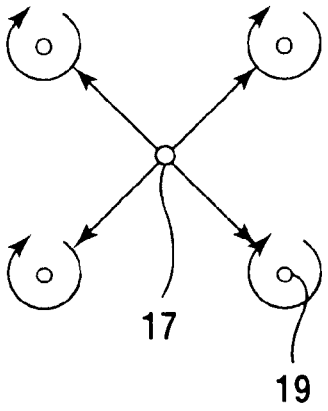
FIGS. 4*a* and 4*b* are diagrams illustrating principles of different kinds of operation of the control unit.
Figure 4B:
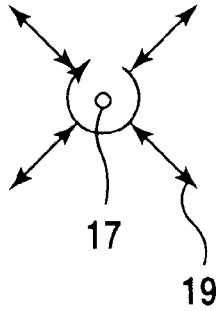

Whereas the rotation of the knob 33 is evaluated through the direct mechanical transmission of force to the rotation detector 43, a pushing movement of the knob 33 is detected through the four microswitches 45 as is illustrated in FIG. 3 and FIG. 4*b* as in the example explained below. The knob can be disposed as an integral part of a display unit, as in the first embodiment example, or it can also, for example, be movably attached in a suitable pattern field separate from the display unit. Individual pattern markings provided in the vicinity of the knob indicate the positions which can be selected.

Alternatively, it is also possible, for example, to fix the control knob in the frame or in a panel of a cooking appliance, or to a separate control device.

In accordance with the top-plan view shown in FIG. 4*a*, the control unit can be operated, for example, by tilting or pushing the control knob 13 out of the central initial position along the axis 17 into the four selection positions indicated by reference numeral 19. The control knob can then be turned in these selection positions indicated by reference numeral 19. Thus, in order to reduce the heating level of the cooking position 9, which is shown in FIG. 1 to have a heat level of "3", the control knob 13, 33 can be tilted to the display element 12 showing "3", or a marking can be provided, and the control knob 13 in the tilted position indicated by reference numeral 19 can then be turned in a counterclockwise direction. Upon being released, the control knob 13, 33 returns automatically to the initial position along the axis 17 due to mechanical or magnetic restoring forces. Depending on the dimensioning and configuration of the magnetic elements for retaining the control knob 13 on the control knob bearing 21, the control knob 13 can typically be tilted by approximately 0.5 to 1.5 cm from the initial position along the axis 17 into the selection position indicated by reference numeral 19. The flexible shaft 39 can be used, for example, to enable the corresponding movement to be as far as several cm. Switching off the cooking position can be accomplished in accordance with FIG. 4*a* in such a way that the control knob 13, 33 in the initial position along the axis 17 is turned, for example, counterclockwise. For reasons of safety, it is also possible to provide a non-illustrated on/off switch at the cook top 1 which operates independently of the control unit and control knob 13, 33.

In accordance with FIG. 4*b*, the control knob 13, 33 can also be operated as follows: In order to select an operating function, i.e. the desired cooking position 9, the control knob is tilted by the operator out of the initial position along the axis 17 into the appropriate selection position indicated by reference numeral 19. The display element 12 signals and acknowledges the selection being made, for example by flashing of the corresponding display element 12. Setting the operating parameters, i.e. the heating level of the selected cooking position 9, is performed by turning the control knob 13, 33 in the initial position along the axis 17. In addition, or alternatively, the possibility can be provided, for example, that a stepwise increase or decrease of a selected cooking position 9 is performed through repeated tilting of the control knob 13, 33 from the initial position along the axis 17 into the appropriate selection position indicated by reference numeral 19.

We claim:

1. A control unit for setting operating functions and operating parameters of an electrical household appliance, comprising:

a control area of an electrical household appliance;

a control knob rotatable and pivotably retained at said control area, said control knob rotatable about an initial axis to set at least one operating parameter and said control knob pivotable away from said initial axis into a plurality of selected positions, each one of said plurality of selected positions for selecting an operating function; and a display unit secured to said control area and having a display element for each one of said plurality of selected positions, each said display element for indicating at least one of said set operating parameter and said selected operating function.

2. The control unit according to claim 1, wherein said at least one operating parameter includes a heating level, and said operating function is a specific cooking position.

3. The control unit according to claim 1, wherein said control knob has a return mechanism automatically returning said control knob to said initial position after movement to said selection position.

4. The control unit according to claim 1, wherein said control knob and said control area have magnetic elements retaining said control knob at said control area yet allowing said control knob to be moved.

5. The control unit according to claim 1, wherein said control knob is removably secured to said control area during normal operation.

6. The control unit according to claim 1, wherein said control knob and said control area have mutually corresponding mechanical guiding elements.

7. The control unit according to claim 6, wherein said control knob covers said guiding elements in said initial position and said selection position.

8. The control unit according to claim 1, including a knob foot bearing with a curved surface, said control knob having a knob foot retained on said knob foot bearing yet allowing said knob foot to tilt and turn, and said knob foot having a surface for sliding on said surface of said knob foot bearing.

9. The control unit according to claim 1, wherein said initial position of said control knob lies approximately at a center of gravity of an area bounded by at least three selection positions of said control knob.

10. The control unit according to claim 1, wherein said control knob rotates in said initial position for switching off the household appliance.

11. The control unit according to claim 1, wherein said control knob is rotatable in said selection position.

12. The control unit according to claim 1, including a rotation detector, a shaft connected between said rotation detector and said control knob, and said control knob having a position detector.

13. The control unit according to claim 1, including a rotation detector, a shaft connected between said rotation detector and said control knob, and said shaft having a position detector.

14. In combination, a cook top with a control area and a control unit, the control unit comprising:

a control knob retained at said control area;

said control knob to be rotated about a knob axis to set operating parameters; and said control knob to be tilted or pushed from an initial position or out of said knob axis into a selection position for selecting a specific operating function.

* * * * *